US007459615B2

(12) United States Patent
Kamada

(10) Patent No.: US 7,459,615 B2
(45) Date of Patent: Dec. 2, 2008

(54) MUSICAL TONE APPARATUS AND METHOD FOR MANUFACTURING OR ALTERING MUSICAL TONE APPARATUS

(75) Inventor: Kenji Kamada, Hamamatsu (JP)

(73) Assignee: Kawai Musical Instruments MFG. Co., Ltd., Hamamatsu-shi (JP)

( * ) Notice: Subject to any disclaimer, the term of this patent is extended or adjusted under 35 U.S.C. 154(b) by 13 days.

(21) Appl. No.: 11/806,048

(22) Filed: May 29, 2007

(65) Prior Publication Data

US 2007/0289428 A1 Dec. 20, 2007

(30) Foreign Application Priority Data

May 31, 2006 (JP) ..... 2006-151287

(51) Int. Cl.
*G10C 3/00* (2006.01)

(52) U.S. Cl. ..... 84/212; 84/280

(58) Field of Classification Search ..... None
See application file for complete search history.

(56) References Cited

U.S. PATENT DOCUMENTS

| | | | | |
|---|---|---|---|---|
| 6,639,135 | B1 * | 10/2003 | Lucas | 84/291 |
| 2001/0010186 | A1 * | 8/2001 | Steinberger | 84/293 |
| 2004/0050235 | A1 * | 3/2004 | McGill | 84/291 |
| 2006/0185494 | A1 * | 8/2006 | Zumsteg | 84/312 P |
| 2007/0107579 | A1 * | 5/2007 | Babicz | 84/293 |

FOREIGN PATENT DOCUMENTS

| | | |
|---|---|---|
| JP | A 53-069624 | 6/1978 |
| JP | U H01-25297 | 2/1989 |
| JP | A 04-056996 | 2/1992 |
| JP | A 04-156799 | 5/1992 |
| JP | A 05-073039 | 3/1993 |
| JP | A 05-080748 | 4/1993 |
| JP | A 08-111896 | 4/1996 |
| JP | A 08-146949 | 6/1996 |

* cited by examiner

*Primary Examiner*—Marlon T Fletcher
(74) *Attorney, Agent, or Firm*—Oliff & Berridge, PLC

(57) ABSTRACT

A soundboard, which vibrates and generates tones, does not hit the mounting member (components); as a result abnormal vibration/noise is not caused; a contact members are contacted and attached on the both sides of the soundboard which generates tones; the contact member is softer than the soundboard; mounting member is harder than the contact members, mounting members are contacted outside the both contact members; all of them from the mounting members through the mounting members are held and fixed with the connect members; the soundboard is detached from the hard mounting members with the soft contact member (sheet) in between; therefore the tone characteristics of the soundboard do not deteriorate, and abnormal vibration/noise caused by resonance of soundboard and other components do not occur.

20 Claims, 3 Drawing Sheets

MUSICAL TONE APPARATUS AND METHOD FOR MANUFACTURING OR ALTERING MUSICAL TONE APPARATUS

BACKGROUND OF THE INVENTION

1. Field of the Invention

The present invention relates to a musical tone apparatus or a method for manufacturing or altering (remodeling) musical tone apparatus, and more particularly, to a structure of equipping a musical instrument with a soundboard which vibrates and generates sound.

2. Description of the Prior Art

Heretofore, in the structure of vibrating a soundboard (diaphragm), an electromagnetic driver (transducer) is contacted or fixed on the soundboard of a piano, tone signals are sent to the electromagnetic driver, the soundboard not the electromagnetic driver is vibrated, and then sounds are generated from the soundboard. The soundboard is mounted (fixed) on a mounting member (component, unit, part) such as a frame.

However, when the soundboard (diaphragm) is driven by the electromagnetic driver, the vibrating soundboard hits the mounting member such as a frame and the both are resonated with each other. As a result abnormal vibration/sound often occurs.

Related works are as follows:

(1) Publication of unexamined utility model applications No. 1-25297

(2) Publication of unexamined patent applications No. 8-146949

(3) Publication of unexamined patent applications No. 8-111896

(4) Publication of unexamined patent applications No. 4-156799

(5) Publication of unexamined patent applications No. 53-69624

(6) Publication of unexamined patent applications No. 4-56996

(7) Publication of unexamined patent applications No. 5-80748

(8) Publication of unexamined patent applications No. 5-73039

SUMMARY OF THE INVENTION

The present invention solves the problem as follows. A contact member (unit) which is lower in hardness and softer than a soundboard is contacted or fixed (fitted) on the both sides of the soundboard. A mounting member (unit) which are in a board-shape and higher in hardness or harder than the contact member are contacted (fixed) outside of the contact member and on the opposite sides of the soundboard. Then plural fixing member go through the soundboard and the contact member making the both the both mounting members (units) close each other to hold and fix them with the mounting.

In this structure, board-sharp of contact member (sheets) lower in hardness and softer than the said soundboard are set between the soundboard and the mounting member (units). It prevents the soundboard and the mounting units from hitting and resonating with each other. As a result abnormal vibration/noise is not caused, tones generated from the soundboard become clearer, and quality of tones generated from the soundboard does not deteriorate.

Since the soundboard is separated and detached from the fixing units piercing the soundboard (from the hardness mounting member by the softness contact member), the acoustic characteristics of the soundboard is not changed easily, abnormal vibration/noise do not occur because of resonance of the soundboard and other members, and quality of tones generated from the soundboard does not deteriorate.

The fixing member go through the soundboard, the soundboard is separated and detached from the fixing member, therefore the acoustic characteristics of the soundboard is not changed easily, abnormal vibration/noise do not occur because of resonance of the soundboard and other components, and quality of tones generated from the soundboard does not deteriorate.

Even if the above mentioned fixing member (units) are tightened so hard as to make the mounting member (units) warp, the compression is absorbed by the contact member (units) and is not transferred to the soundboard. Therefore the soundboard is not made warped, bent or deformed and acoustic characteristics of the soundboard are not changed. Abnormal vibration/noise does not occur and quality of tones generated from the soundboard does not deteriorate since the soundboard does not hit the mounting member (units) so strongly as to cause resonance.

DESCRIPTION OF THE PREFERRED EMBODIMENT

Figure 1:
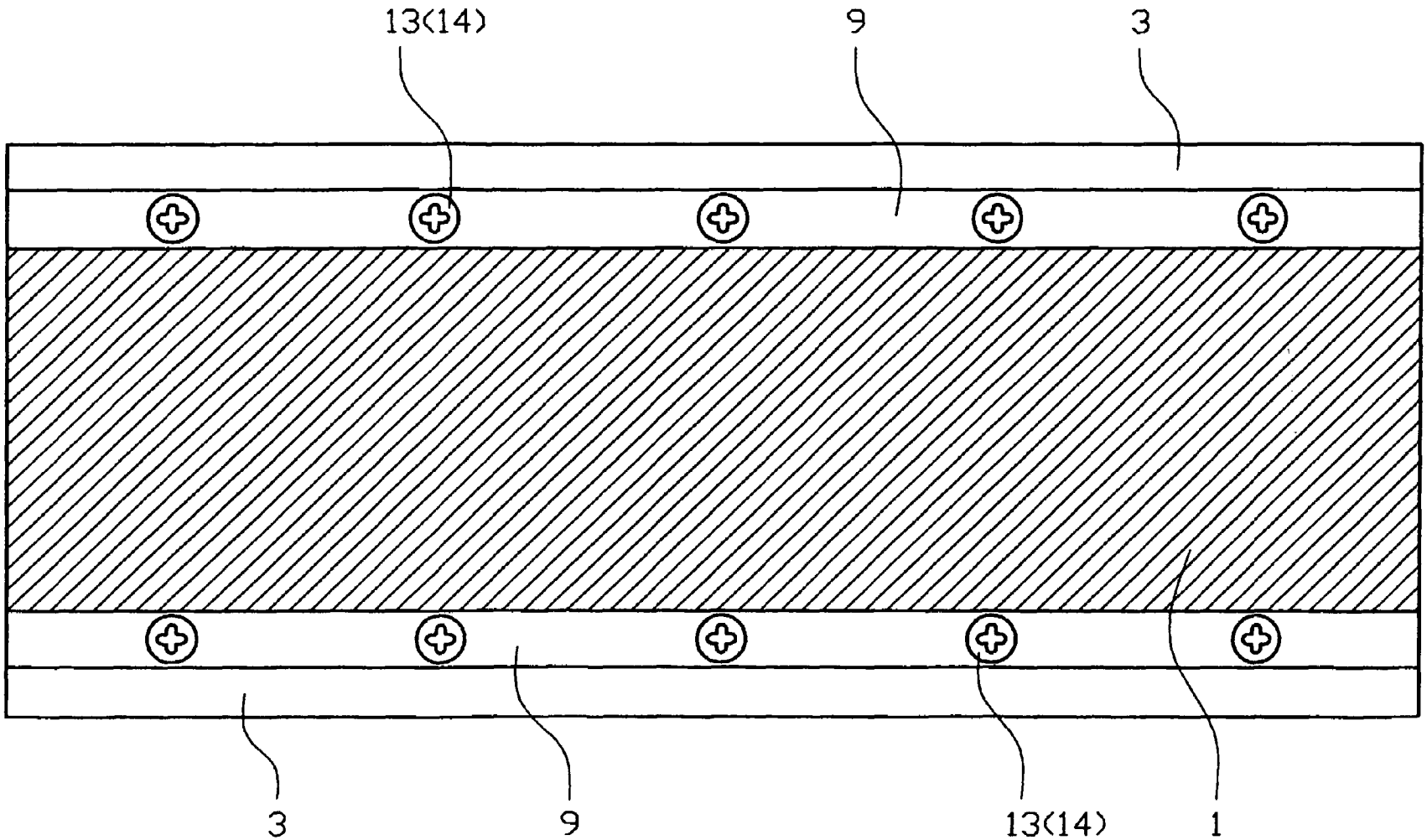
FIG. 1 is a front view of the structure/method of installing the soundboard 1 and the method for producing/processing the musical tone apparatus.

A rear contact sheet 5 and a front contact sheet 7 are contacted (attached) on the both sides of a soundboard 1 which generates tones. The contact sheet 5 and 7 are softer than the soundboard 1 and has no natural frequency. Outside the both contact sheets 5 and 7, a rear mounting component 3 and a front mounting component 9, harder than the contact sheets 5 and 7, are set. All of them from the front mounting component 9 through the rear mounting component 3 are hold and fixed with connect screws 13 . . . . In this structure the soundboard 1 is detached from the hard mounting components 3 and 9 with the soft contact sheets 5 and 7 in between. Therefore the tone characteristics of the soundboard 1 do not deteriorate, and abnormal vibration/noise caused by resonance of soundboard 1 and other components do not occur.

(1) Soundboard 1

The soundboard 1 is a wooden rectangular board. The soundboard 1 is employed (adopted) to acoustic musical instruments, electronic musical instruments such as electronic piano, electronic organ and silent piano and musical instruments combined these musical instruments. Tones are generated when the soundboard 1 vibrates. The materials of the soundboard 1 are dry or moist wood, wood with resin soaked in or without resin, plywood, collective wood, glass or hard resin such as acrylic resin.

The kinds of wood employed of or to the soundboard 1 are the same as those for acoustic keyboard instruments such as piano, organ, or electronic keyboard instruments such as silent piano, electronic piano and organ. The materials may be the same as the wooden parts of a front board, a rear board, a side board, a body and a fingerboard of stringed instruments such as cello and violin, and also of a sound generator, a membrane or a body of percussion instruments such as xylophones and drums, etc.

The materials for the above mentioned soundboard 1 may be aluminum, stainless-steel, iron, titanium, magnesium, brass, platinum, an alloy of some of these metals, steel sheet such as cool-rolled steel sheet, glass or hard resin such as acrylic resin. Also the materials may be the same kinds of metals as those applied to reeds and bodies of wind instruments such as flute and oboe, or tone generators and bodies of percussion instruments such as cymbals and triangles.

The soundboard 1 is flat with a plane surface. Therefore sound generated from the soundboard 1 is carried on a plane wave. Unlike spherical waves, even if a poison of a listener's or player's ears move from the soundboard 1, difference of sound pressure to the right and left ears dose not change, sound image hold same position, sound image position is fixed and dose not change along a wide space.

If the soundboard 1 is divided to plural pieces, extended horizontal, positioned ordinates and high tone generates from one soundboards 1 . . . , middle tone generates from the another soundboards 1 . . . and low tone generates from the other soundboards 1 . . . , therefore the generate places of the high, middle and low tone are positioned vertical. As these tones are carried on plane waves, even if listener's or player's right and left ears far right, left, upper or lower, difference of sound pressure to the right and left ears dose not change, sound image position dose not change in connection with the high, middle and low tone and tones do not sound strange to the listener or the player.

Even if these divided soundboards 1 . . . are extended vertical, positioned abscissas, difference of sound pressure to the right and left ears change, sound image position changes in connection with the high, middle and low tone and tones sound strange to the listener or the player.

Figure 2:
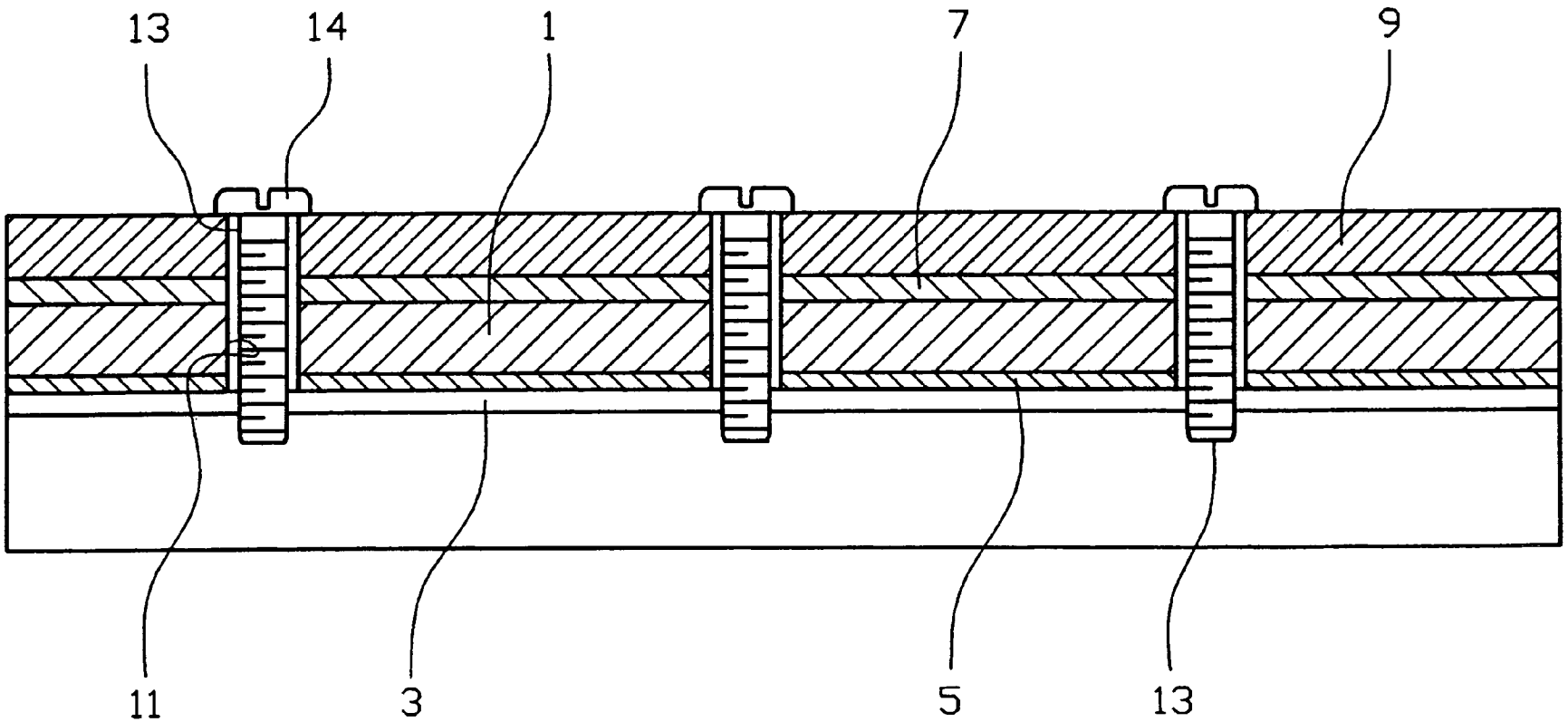
FIG. 2 is a plan view of the structure/method of installing the soundboard 1 and the method for producing/processing the musical tone apparatus.
Figure 3:
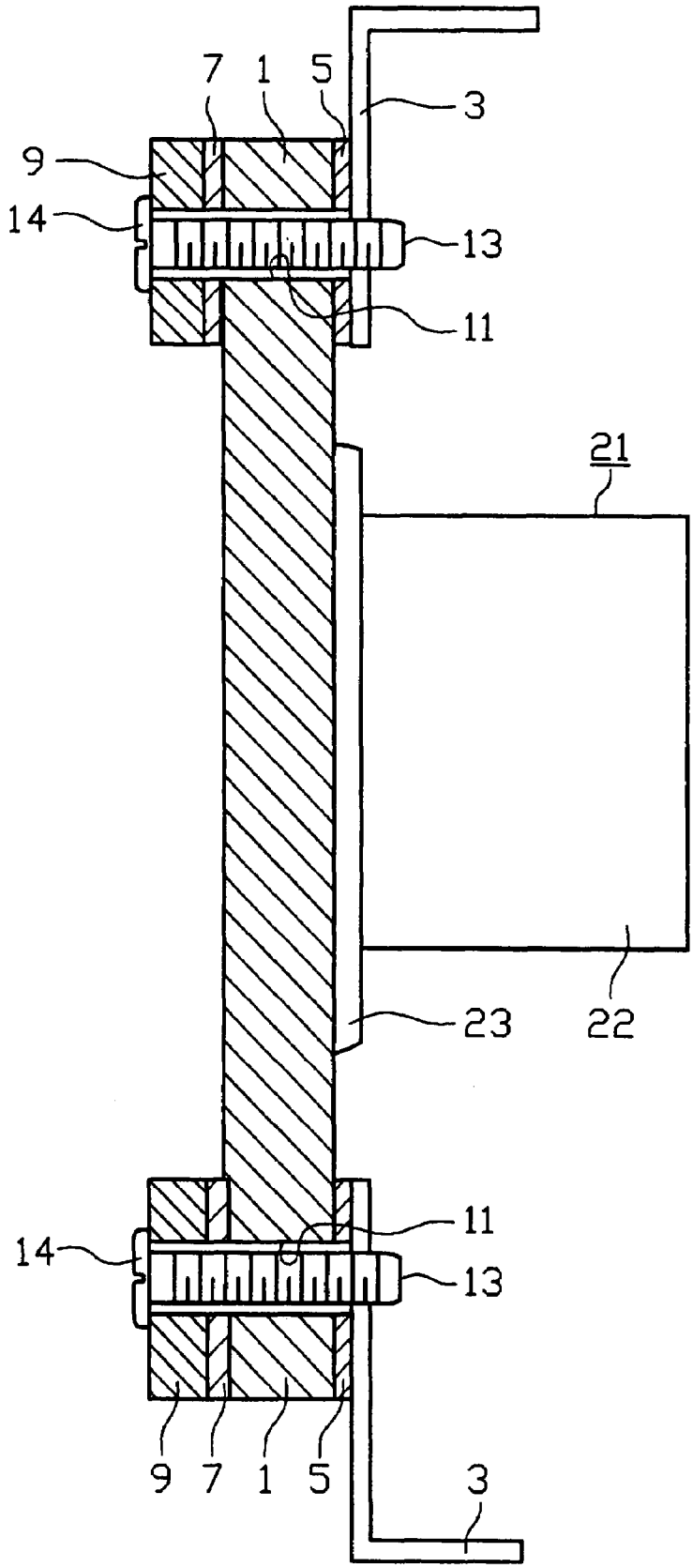
FIG. 3 is a side view of the structure/method of installing the soundboard 1 and the method for producing/processing the musical tone apparatus.

(2) The Structure/Method for Mounting (of Installing) the Soundboard 1/the Method for Manufacturing the Musical Tone Apparatus FIGS. 1, 2 and 3 show the structure/method of installing the soundboard 1/the method for manufacturing the musical tone apparatus. The rear mounting component 3 is or is fixed to the side panels, the wood frame, the side soundboard, the poles, the framework, the roof, the bottom the shelf and the frame in a musical instrument.

The rear mounting component 3 is a wide metal plate and its cross section is an L-shape. A pair of rear mounting components 3 is placed symmetrically at the top and the bottom of the soundboard 1. A pair of board-sharp rear contact sheets 5 is respectively fixed (fitted) on the front of the longer sides of the rear mounting components 3. The width of the rear contact sheet 5 is smaller than that of the longer side of the rear mounting component 3.

The soundboard 1 is piled up and contacted (fixed) on the front side of the rear contact sheet 5. The width (length) of the soundboard 1 is approximately the same as the distance from the top edge of the upper contact sheet 5 to the bottom edge of the lower contact sheet 5. A pair of the front contact sheets 7 is contacted (fixed) on the front side of the sound board 1 respectively along the top edge and the bottom edge of the soundboard 1. The width (length) of the front contact sheet 7 is approximately the same as that of the rear contact sheet 5 and smaller than that of the one side of L-shape the rear mounting component 3.

The board-shape of front mounting component 9 piled up and contacted or is a board fixed on the front side of each contact sheet 7. The width (length) of the front mounting component 9 is approximately the same as those of the front contact sheet 7 and the rear contact sheet 5, and is smaller than that of the one side of the rear mounting component 3.

A through-hole 11 go through the same plural points of front mounting component 9, the front contact sheet 7, the rear contact sheet 5, the rear mounting component 3 and the soundboard 1. Inside the through-hole 11 at the rear mounting (fixing) component 3, a groove is formed for a screw, while at the front mounting component 9, the front contact sheet 7, the rear contact sheet 5 and the soundboard 1 the through-holes 11 has no grooves for a screw and is slightly larger in diameter than at the rear mounting (fixing) component 3.

A connect screws 13 . . . goes into the through-hole 11 . . . of the front mounting component 9 through the through-hole 11 . . . of the rear mounting component 3 to fasten them. The diameter of the head 14 of the connect screw 13 is larger than the inside diameter of the through-hole 11. The diameter of the through-hole 11 . . . through the front mounting component 9, the front contact sheet 7, the rear contact sheet 5 and the soundboard 1 is slightly larger than the diameter of the through-hole 11 . . . of the rear mounting component 3. So the connect screws 13 . . . does not touch and fasten tightly the front mounting component and the front contact sheets 7 and the rear contact sheet 5.

The connect screw 13 goes through the soundboard 1, the front contact sheet 7 and the rear contact sheet 5 to connect them, but it does not screw them up tightly so as to prevent the soundboard 1 from being warped, distorted or deformed. As a result the sound characteristics of the soundboard 1 are not changed. Resonance and abnormal vibration/noise do not occur and quality of tones generated from the soundboard 1 does not deteriorate as the soundboard 1 is not pressed partly and strongly to the rear mounting component 3 and the front mounting component 9.

Vibration of the soundboard 1 is not transferred to the connect screw 13. Therefore the sound characteristics of the soundboard 1 are not unintentionally changed. The soundboard 1 and the connect screw 13 do not resonate resulting in abnormal vibration/noise, and quality of toned generated from the soundboard 1 does not deteriorate.

Plural of connect screws 13 . . . go through the soundboard 1, the rear contact sheet 5, the front contact sheet 7, the rear mounting component 3 and the front mounting component 9. As the connect screws 13 . . . are tightened up, the rear mounting component 3 and the front mounting component 9 become closer to each other at the plural screw points. The soundboard 1, the rear contact sheet 5 and the front sheet 7 are fixed at the plural screw points between the rear mounting component 3 and the front mounting component 9.

The front mounting component 9 is not a small piece fixed just around the connect screws 13 . . . but along continuous board with plural of the (several) connect screws 13 . . . . Therefore the front mounting component 9 equally fastens and applies pressure to the soundboard 1 and the front contact sheet 7. Then sound quality of the soundboard 1 is not changed, resonance and abnormal vibration/noise do no occur as the soundboard 1 is not pressed partly and strongly to the rear mounting component 3 and the front mounting component 9, and quality of tones generated from the soundboard 1 does not deteriorate.

Similarly the rear mounting component 3 is not a small piece fixed just around the connect screws 13 . . . but along continuous board with plural of the (several) connect screws 13 . . . . Therefore the front mounting component 9 equally fastens and applies pressure to the soundboard 1 and the front contact sheet 7. Then sound quality of the soundboard 1 is not changed, resonance and abnormal vibration/noise do no occur as the soundboard 1 is not pressed to the rear mounting component 3 and the front mounting component 9, and quality of tones generated from the soundboard 1 does not deteriorate.

The connect screws 13 are equally fastened and equally apply pressure at plural (several) points of the soundboard 1, the rear contact sheet 5, the front contact sheet 7, the rear mounting component 3 and the front mounting component 9. Therefore the soundboard 1 is not warped, distorted or deformed and sound quality of the soundboard 1 is not changed. The soundboard 1 is not pressed strongly and partly the rear mounting component 3 and the front mounting component 9 resulting in resonance and abnormal vibration/noise. The quality of tones generated from the soundboard 1 does not deteriorate.

The rear contact sheet 5 and the front contact sheet 7 are contacted on both sides of the soundboard 1. The rear mounting component 3 and front mounting component 9 are contacted on one side of the rear contact sheet 5 and the front contact sheet 7, that is, the opposite side of the soundboard 1.

The soundboard 1, the rear contact sheet 5, the front contact sheet 7, the rear mounting component 3 and the front mounting component 9 are approximately the same in length horizontally. The length, however, does not have to be the same. The front mounting component 9 is slightly thinner than the soundboard 1. However, it may be thicker or the width may be the same. The rear contact sheet 5, the front contact sheet 7 and the rear mounting component 3 are slightly same width each other and thinner than the front mounting component 9. However, it may be thicker or the width may be the same.

The above mentioned musical tone apparatus is manufactured or altered (processed) in the order of setting the rear mounting component 3, the rear contact sheet 5, the soundboard 1, the front contact sheet 7 and the front mounting component 9 to be contacted and fixed. However, the following order is also adaptable:

First, on the both sides of the soundboard 1, the rear contact sheet 5 and the front contact sheet 7 are contacted and piled up. Then the rear mounting component 3 and the front mounting component 9 are contacted and piled up. The connect screws 13 . . . fasten and fix all of them. The electromagnetic driver (transducer) unit 21 is mounted (fixed) on the rear side. The whole unit is set in the musical instrument.

In the case of this, setting the unit in the order of the rear mounting component 3, the rear contact sheet 5, the soundboard 1, the front contact sheet 7 and the front mounting component 9, they may be contacted, piled up, fastened and fixed with the connect screws 13 . . . and the whole unit is fixed and set in the musical instrument.

(3) Materials/Hardness/Natural Frequency of the Soundboard 1, the Rear Contact Sheet 5, the Front Contact Sheet 7, the Rear Mounting Component 3 and the Front Mounting Component 9

The material of the soundboard 1 is wood as mentioned above. The material of the rear mounting component 3 and the front mounting component 9 is a steel plate such as cool-rolled steel plate. The material may be aluminum, stainless steel, iron, titan, magnesium, brass, platinum, alloy of these materials, glass, or hard resin such as acrylic resin. The material also may be the same kind of metals applied to reeds or bodies of wind instruments such as flute and oboe, tone generator or bodies such as cymbals and triangles.

The materials for the rear contact sheet 5 and the front contact sheet 7 are flexible soft resin such as urethane foam, urethane elastomer, styrene polymer, epoxy resin, vinyl chloride, vinyl acetate and synthetic rubber. Or they may be made of cloth, paper or pulp as well. The density is 690 kg/m$^3$. The 25% compressive strength is 1.06 Mpa, the tensile strength is 2.67 Mpa, the elongation percentage is 150%, the tear resistance is 8.60N/mm and the compressive permanent set is 7.6%.

As compared to the soundboard 1, the rear mounting component 3 and the front mounting component 9, the connect screw 13 and the diaphragm 23, the rear contact sheet 5 and the front contact sheet 7 are smaller in density, in 25% compressive strength, in tensile strength and in tear resistance, but larger in elogation percentage and compressive permanent set.

The rear contact sheet 5 and the front contact sheet 7 are lower in hardness and softer than the soundboard 1. The rear mounting component 3, the front mounting component 9, the connect screw 13 and the diaphragm 23 are higher in hardness and harder than the rear contact sheet 5 and the front contact sheet 7. The rear mounting component 3, the front mounting component 9, the connect screw 13 and the diaphragm 23 are higher in hardness, harder than or same hard as the soundboard 1.

The hardness mentioned above is shown by the value calculated as follows: press a pressure sample at a certain load and devide the depth or the load by the pressed area. In same cases the hardness is shown by the value of one of, or the value of some or all added/multiplied of the density, the 25% compressive strength, the tensile strength, the elongation percentage, the tear resistance and the compressive permanent set.

The hardness of the rear contact sheet 5 and the front contact sheet 7 has to be ⅔ to 1/10, preferably ½ to ⅕, or more preferably ⅓ to ¼ of those of the soundboard 1, the rear mounting component 3, the front mounting component 9, the connect screw 13 and the diaphragm 23. As a result of realizing such hardness, resonance and abnormal vibration/noise do not occur as the soundboard 1 and the rear mounting component 3 or the front mounting component 9 do not hit each other. Then tones generated from the soundboard 1 become clear, and the quality of tones generated from the soundboard 1 does not deteriorate.

If the value of the hardness of the rear contact sheet 5 and the front contact sheet 7 is very close to that of the soundboard 1, the rear mounting component 3, the front mounting component 9, the connect screw 13 and the diaphragm 23, much of vibration/sound is lost as transformed from the diaphragm 23 to the soundboard 1. However, there will be less abnormal vibration/noise caused by resonance of the diaphragm 23 and the soundboard 1, and quality of tones generated from the soundboard 1 does not deteriorate. If value of the hardness of them is very different from each other, loss of vibration/sound transferred from the diaphragm 23 to the soundboard 1 becomes small. However, there will be much abnormal vibration/noise caused by resonance of the diaphragm 23 and the soundboard 1, and quality of tones generated from the soundboard 1 deteriorates.

The natural frequencies of the rear mounting component 3, the front mounting component 9, the connect screw 13 and the diaphragm 23 are approximately the same as or very close to that of the soundboard 1 when their forms and sizes are the same. The natural frequency of the rear contact sheet 5 and the front contact sheet 7 is several times as much as or very different from those of the soundboard 1, the rear mounting component 3, the front mounting component 9, the connect screw 13 and the diaphragm 23 when their forms and sizes are the same.

Some materials of the rear contact sheet 5 and the front contact sheet 7 have no natural frequencies. The natural frequencies of each member or such materials are not decayed when no force is applied to them. Resonance occurs at or around such natural frequencies. The natural frequencies change according to material, size, width, thickness and form of the member. To compare natural frequencies, they should be compared in the same form and size.

The rear contact sheet 5 and the front contact sheet 7 are lower in hardness and softer than the soundboard 1. They have no natural frequency or different natural frequency from the soundboard 1, the fear mounting component 3 and/or the front mounting component 9. The soundboard 1 is set between the rear contact sheet 5 and the front contact sheet 7. Therefore the vibration of the soundboard 1 is not transferred to the rear mounting component 3 and the front mounting component 9. The vibration of the soundboard 1 and the vibration of the rear mounting component 3 and the front mounting component 9 do not resonate or cause abnormal vibration/noise. So quality of tones generated from the soundboard 1 does not deteriorate.

The soundboard 1, which is a sound generator, is detached and isolated from the hard rear mounting component 3 and front mounting component 9 with the rear contact sheet 5 and the front contact sheet 7 which are flexible or in between. As a result it prevents the tone characteristics of the soundboard 1 from being unintentionally changed. In addition it avoids resonance of the soundboard 1 and the other components. Consequently quality of tones generated from the soundboard 1 does not deteriorate.

Since the through-holes 11 . . . of the soundboard 1 are slightly larger around than the connect screws 13 . . . , the connect screws 13 . . . does not touch the soundboard 1. Therefore the tone characteristics of the soundboard 1 are not changed. The soundboard 1 does not resonate with the other components and abnormal vibration/noise does not occur. And quality of tones generated from the soundboard 1 does not deteriorate.

If the connect screws 13 . . . are tightened too hard, the rear mounting component 3 or the front mounting component 9 may be bent and warped off the soundboard 1. But the rear contact sheet 5 and the front contact sheet 7 absorb and do not transfer to the soundboard 1 any force such as fixing, pressure, warp, distort, deform and flexibility etc. caused by tightening the screw too hard.

Due to the above structure, the soundboard 1 is not warped, distorted or deformed. Therefore the tone characteristics of the soundboard 1 are not changed. The soundboard 1 does not hit the rear mounting component 3 or the front mounting component 9. As a result resonance and abnormal vibration/noise are not caused.

Also the rear mounting component 3 or the front mounting component 9 is not warped or hit the soundboard 1 when it vibrated. Then abnormal vibration/noise is not caused and quality of tones generated from the soundboard 1 does not deteriorate.

(4) The Structure of the Electromagnetic Diver (Transducer) Unit 21

The electromagnetic driver (transducer) unit 21 externally appears to consist of a columnar case 22 containing the electromagnetic driver and a circular and flat diaphragm 23 set at the bottom of the case 22. Inside the electromagnetic driver unit 21 a coil and magnets are contained. The coil connects the case 22 or the diaphragm 23 at one end and the magnets at the other end.

When tone signals composed of various tones reach the coil, the magnetic fields around the coil and the magnets affect each other to make the coil or the magnets vibrate and the diaphragm 23 vibrate from the case 22. The case 22, that is, either the coil or the magnets is fixed to the body of the musical instrument which is heavier than the soundboard 1. The other end, that is, the diaphragm 23 is contacted or connected to the soundboard 1 directly or indirectly through the connected member or with some joints.

In this structure the diaphragm 23 and the soundboard 1 are made electromagnetically driven and vibrated from the body of the musical instrument. The electromagnetic driver unit 21 itself, unlike speaker, does not generate/radiate sounds, but it makes other contacted objects or connected parts electromagnetically driven and generate/radiate sounds. Such an electromagnetic driver unit 21 is disclosed in Publications of unexamined patent applications No. 8-146949 and No. 8-111896.

The diaphragm 23 of the electromagnetic driver unit 21 is contacted or connected to the back surface of the soundboard 1 with bolts, screws, welding or adhesion. The diaphragm 23 and the soundboard 1 are both flat and roughly parallel to each other. If they are roughly parallel, they may have spherical, cylindrical, warped or polyhedral surfaces as well as flat surfaces. When they are parallel, sound/vibration are transferred uniformly from the diaphragm 23 to the soundboard 1, and quality of tones generated from the soundboard 1 does not deteriorate. The diaphragm 23 and the soundboard 1 do not always have to be parallel.

The diaphragm 23 of the electromagnetic driver unit 21, unlike cone speakers and flat diaphragms, is heavy and needs powerful signals to drive. The diaphragm itself does not generate sounds but transfers vibration to other parts such as the soundboard 1 to make them generate sounds.

Since the diaphragm 23 itself of the electromagnetic driver unit 21 does not radiate sounds, sounds generated from the diaphragm 23 of the electromagnetic driver unit 21 do not have to be taken into consideration, and sounds generated from the soundboard 1 is the only necessary to be taken into consideration. And it makes easier to analyze the sounds generated from the whole musical tone apparatus. The diaphragm 23 itself of the electromagnetic unit 21 may radiate sounds.

(5) Description of the Other Embodiments

The embodiment of the present invention is not limited to the mentioned above, but some modification is allowed as far as it does not deviate from the purpose of the invention. For example, either or some parts of the rear contact sheet 5 and the front contact sheet 7 may by eliminated. Or there may be more contact sheets.

Either or some parts of the rear mounting component 3 and the front mounting component 9 may be eliminated. Or there may be more mounting components. The rear contact sheet 5 may be one continuous sheet covering the whole back surface of the soundboard 1.

Around the connect screw 13 the same sheet as the rear contact sheet 5 and the front contact sheet 7 may be wound and this sheet may be between the connect screws 13 . . . and the soundboard 1. It prevents the soundboard 1 and the connect screws 13 . . . from resonating each other to generate abnormal vibration/noise.

The sizes of the electromagnetic drive unit 21 and the diaphragm 23 may be changed. The soundboard 1 is flat, but it may be curved outward or inward. In such a case waveforms of tones generated from the soundboard 1 are spherical waves' not plain waves.

The tone signals of various tones are consisted of signals of various musical instruments, timbre, pitch and/or touch. They are polyphonic tones including each frequency band of high, middle and low tones. Such tone signals include those of strings, pipes and percussions and also of the soundboard. The tone signals may only be those of strings, pipes and percussions. Or they may only be those of the soundboard.

The connect screws 13 . . . may be the same as the diaphragm 23, the rear mounting component 3 or the front mounting component 9 in material, natural frequency and hardness. The diaphragm 23 may be the same as the rear mounting component 3 or the front mounting component 9 in material, natural frequency and hardness. It reduces the loss of vibration/sound as reflected among the diaphragm 23, the connect screws 13 . . . , and the rear mounting component 3 and the front mounting component 9. Of course they may have different materials, natural frequencies and hardness.

The diaphragm 23 may be the same as the soundboard 1 in material, natural frequency and hardness. It reduces the loss of vibration/sound as reflected between the diaphragm 23 and the soundboard 1. Of course they may have different materials, natural frequencies and hardness.

The number of the connect screw 13 may be one. If the connect screws 13 . . . are able to hold and connect the rear mounting component 3 and the front mounting component 9, the structure may be similar to a vise holding from the both ends and connecting the rear mounting component 3 and the front mounting component 9.

The rear mounting component 3 or the front mounting component 9 may be divided to plural pieces for each of connect screws 13 . . . . Accordingly the rear contact sheet 5 and the front contact sheet 7 may also be divided to plural pieces for each of the connect screws 13 . . . . The length of the rear mounting component 3, the front mounting component 9, the rear contact sheet 5, the front contact sheet 7 and the soundboard 1 may be different from each other.

The rear mounting component 3, the front mounting component 9, the rear contact sheet 5 and the front contact sheet 7 are boards. As far as they are in a board-shape, they may be curved outward or inward. Accordingly the soundboard 1 is curved as mentioned above.

The rear mounting component 3 and the front mounting component 9 may be thicker or thinner than, or as thick as the rear contact sheet 5, the front contact sheet 7 and the soundboard 1. The rear contact sheet 5 and the front contact sheet 7 may be thicker or thinner than, or as thick as the soundboard 1.

(6) The Other Effects of the Invention

Vibration of the soundboard is not transferred to other mounting member (units) when it is vibrating and generating sounds. It means that the soundboard and other mounting member (units) do not resonate and hit each other and that abnormal vibration/noise does not occur.

Each of the mounting member (units) is a board extending over the plural of the fixing member (units), is not a small part just placed around the each fixing member (units). Therefore the mounting member for the soundboard and the contact member (units) are fixed, held, pressed uniformly. As a result the soundboard is not curved, warped or deformed, and tone characteristics of the soundboard do not change. The soundboard does not hit the mounting units so that resonation and abnormal vibration/noise do not occur.

The fixing members (units) are held, pressed and fixed the soundboard, the contact member (units) and the mounting member (units) at plural or several points. Therefore pressure to all over the soundboard is uniform and well-balanced. As a result the soundboard is not curved, warped or deformed. The tone characteristics of the soundboard do not change. The soundboard does not hit the mounting member (units) so that resonation and abnormal vibration/noise do not occur.

When the soundboard and the vibrating part of the electromagnetic driver unit are parallel, the transfer characteristics of sound/vibration from the vibrating part of the electromagnetic driver unit to the soundboard is always invariable, and quality of tones generated from the soundboard does not deteriorate. Since the vibrating part of the electromagnetic driver unit does not radiate sounds, it is not necessary to take into consideration sounds generated from any connecting member (units) or from the driving part of the electromagnetic driver unit. It is necessary to consider only sounds generated from the soundboard. Consequently analysis of sounds generated from the whole musical tone apparatus is made easier.

The tone generators on each soundboard are placed ordinates and each tone is carried on a plane wave. Therefore even if a listener's or players' ears are far right, left, upper or lower away, a difference (gap) of sound pressure to the right and left ears does not change, sound image position dose not change, tones do not sound strange. Even if abnormal vibration/noise occurs, a listener or player does not recognize a difference (gap) of sound pressure and is not bothered about abnormal vibration/noise.

Abnormal vibration/noise does not occur caused by resonance when the soundboard and the mounting member (component) hit each other. As a result tones generated from the soundboard are clear.

The invention claimed is:

1. A musical tone apparatus comprising:

at least one soundboard in a musical tone apparatus for vibrating and generating sounds;

at least two board-shape contact member for being softer than the soundboard and being contacted on the both sides of the soundboard;

at least two mounting members for being harder than the contact member, being contacted on one side of the both contact member and on the opposite side of said soundboard of the both contact member;

a plural of fixing member for going through said soundboard and said both contact member, making said both mounting member closer to each other and holding and fixing said soundboard and said both contact member between said mounting member.

2. The musical tone apparatus comprising according to the claim 1, the mounting member is harder than or the same hard as the soundboard.

3. The musical tone apparatus comprising according to the claim 2, natural frequencies of the mounting member is approximately the same as or very close to that of the soundboard when their forms and sizes are the same.

4. The musical tone apparatus comprising according to the claim 2, natural frequencies of the contact member is several times as much as or very different from those of the soundboard or the mounting member when their forms and sizes are the same.

5. The musical tone apparatus comprising according to the claim 2, the contact member has no natural frequencies.

6. The musical tone apparatus comprising according to the claim 1, the plural fixing member go through the soundboard and the both contact member at plural points, making the both mounting member closer to each other at plural points and holding and fixing the soundboard and the both contact member between said mounting member.

7. The musical tone apparatus comprising according to the claim 2, the plural fixing member go through the soundboard and the both contact member at plural points, making the both mounting member closer to each other at plural points and holding and fixing the soundboard and the both contact member between said mounting member.

8. The musical tone apparatus comprising according to the claim 1, an electromagnetic driver member is mounted to the soundboard, a tone signal which is consisted of signals of various tones is converted to mechanical vibration by the electromagnetic driver member, the soundboard is drive or vibrated and a sound is generated.

9. The musical tone apparatus comprising according to the claim 2, an electromagnetic driver member is mounted to the soundboard, a tone signal which is consisted of signals of various tones is converted to mechanical vibration by the electromagnetic driver member, the soundboard is drive or vibrated and a sound is generated.

10. The musical tone apparatus comprising according to the claim 1, the driving part in the electromagnetic driver member is roughly parallel to the surface of the soundboard and does not radiate sounds.

11. The musical tone apparatus comprising according to the claim 2, the driving part in the electromagnetic driver member is roughly parallel to the surface of the soundboard and does not radiate sounds.

12. The musical tone apparatus comprising according to the claim 2, the soundboard is divided to plural pieces, these soundboards are extended horizontal, positioned ordinates.

13. The musical tone apparatus comprising according to the claim 2, a hardness of the contact member has to be ⅔ to 1/10, preferably ½ to ⅕, or more preferably ⅓ to ¼ of those of the soundboard, the mounting member, the mounting member, the fixing member and the driving part in the electromagnetic driver member.

14. A method for manufacturing or altering musical tone apparatus comprising:

contacting at least two board-shape contact member which are softer than a soundboard to the both sides of the soundboard in a musical tone apparatus for vibrating and generating sounds;

contacting at least two board-shape mounting member which are harder than the contact member on one side of the both contact member and on the opposite side of said soundboard going through said soundboard and said both contact member by plural fixing member, making said both mounting member closer to each other and holding and fixing said soundboard and said both contact member between said mounting member.

15. The method for manufacturing or altering musical tone apparatus comprising according to the claim 14, the mounting member are harder than or same hard as the soundboard.

16. The method for manufacturing or altering musical tone apparatus comprising according to the claim 15, natural frequencies of the mounting member is approximately the same as or very close to that of the soundboard when their forms and sizes are the same.

17. The method for manufacturing or altering musical tone apparatus comprising according to the claim 15, natural frequencies of the contact member is several times as much as or very different from those of the soundboard or the mounting member when their forms and sizes are the same.

18. The method for manufacturing or altering musical tone apparatus comprising according to the claim 15, the contact members have no natural frequencies.

19. The method for manufacturing or altering musical tone apparatus comprising according to the claim 13, The plural fixing member go through the soundboard and the both contact member at plural points, making the both mounting member closer to each other at plural points and holding and fixing the soundboard and the both contact member between said mounting member.

20. The method for manufacturing or altering musical tone apparatus comprising according to the claim 14, The plural fixing member go through the soundboard and the both contact member at plural points, making the both mounting member closer to each other at plural points and holding and fixing the soundboard and the both contact member between said mounting member.

* * * * *